US007991332B2

(12) United States Patent
Sakamaki

(10) Patent No.: US 7,991,332 B2
(45) Date of Patent: Aug. 2, 2011

(54) DEVELOPING APPARATUS HAVING A FEEDING MEMBER FOR FEEDING A DEVELOPER

(75) Inventor: Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 992 days.

(21) Appl. No.: 11/689,809

(22) Filed: Mar. 22, 2007

(65) Prior Publication Data

US 2007/0231015 A1 Oct. 4, 2007

(30) Foreign Application Priority Data

Mar. 29, 2006 (JP) ..... 2006-092580

(51) Int. Cl.
*G03G 15/08* (2006.01)

(52) U.S. Cl. ..... 399/257

(58) Field of Classification Search ..... 399/257, 399/264; 366/196, 322, 323, 324
See application file for complete search history.

(56) References Cited

U.S. PATENT DOCUMENTS

| | | | | |
|---|---|---|---|---|
| 6,973,281 | B2 | 12/2005 | Hirobe et al. | |
| 6,978,106 | B2 | 12/2005 | Masuda | 399/260 |
| 7,099,609 | B2 | 8/2006 | Hirobe et al. | |
| 7,231,154 | B2 | 6/2007 | Sakamaki | |
| 2004/0114966 | A1 | 6/2004 | Masuda | |
| 2004/0179865 | A1 * | 9/2004 | Nishiyama | 399/254 |
| 2007/0053724 | A1 | 3/2007 | Akashi et al. | |
| 2007/0053725 | A1 | 3/2007 | Sakamaki et al. | |

FOREIGN PATENT DOCUMENTS

| | | |
|---|---|---|
| JP | 06-274030 A | 9/1994 |
| JP | 2000-112238 | 4/2000 |
| JP | 2004-206088 | 7/2004 |
| JP | 2004-206088 A | 7/2004 |

OTHER PUBLICATIONS

European Search Report dated Aug. 16, 2007 in counterpart European Application No. EP 07 00 6272.

* cited by examiner

*Primary Examiner* — David P Porta
*Assistant Examiner* — Carolyn Igyarto
(74) *Attorney, Agent, or Firm* — Fitzpatrick, Cella, Harper & Scinto

(57) ABSTRACT

A developing apparatus includes a developer container that contains a developer and a supply device that supplies a supply developer to the developer container. A feeding member that feeds the developer is disposed close to a discharge opening in the developer container, which allows the discharge of the developer contained in the developer container. The feeding member has a developer feeding power in an opposing area, in which the developer feeding member is opposed to the discharge opening, larger than a developer feeding power in an upstream-side area, which is upstream of the opposing area with respect to a developer feeding direction. Further, the feeding member has a developer feeding power in a downstream-side area, which is downstream of the opposing area with respect to the developer feeding direction, equal to or larger than the developer feeding power in the opposing area.

13 Claims, 9 Drawing Sheets

(a)

(b)

(a)

(b)

DEVELOPING APPARATUS HAVING A FEEDING MEMBER FOR FEEDING A DEVELOPER

FIELD OF THE INVENTION AND RELATED ART

The present invention relates to a developing apparatus which uses an electrophotographic method, an electrostatic recording method, or the like, to form a visible image by developing an electrostatic latent image formed on an image bearing member. In particular, the present invention relates to a developing apparatus, using a two-component developer including a toner and a carrier, for use in an image forming apparatus such as a copying machine, a printer, a recorded image display apparatus, or a facsimile apparatus.

In the field of an image forming apparatus employing an electrophotographic method or an electrostatic recording method, in particular, a color image forming apparatus which forms a full-color image, a multicolor image, or the like, with the use of an electrophotographic method, a two-component developer has been used in almost all developing apparatuses, from the standpoint of color generation and color mixture.

In the developing method which uses the two-component developer, as is well known, a toner is electrically charged by the friction between the carrier and the toner, and an image is formed by electrostatically depositing the electrically charged toner on a latent image. In order to form an image which is satisfactory in that it is highly durable and fast in color, it is essential to ensure that the toner is consistently given a proper amount of a triboelectric charge, and for this purpose, the carrier must be durable and stable in terms of its capability to triboelectrically charge the toner.

In reality, however, the toner is gradually consumed by a developing operation, whereas the carrier is not consumed and remains in a developing apparatus. With the elapse of time (as the carrier is used for a long time), the surfaces of carrier particles are contaminated by deposition of an external additive and/or the toner since the carrier is stirred together with the toner for a long time. As a result, the carrier is reduced in its capability to impart the triboelectric charge to the toner. Therefore, the toner is not given the proper amount of triboelectric charge. When the toner is not given the proper amount of triboelectric charge, image deterioration such as scattering, fog, or the like is caused to occur.

With respect to such a problem, it has been a common practice for a service person or the like to replace the developer with an expired service life in a developing apparatus with a fresh developer during regular maintenance. This method, however, has its own problem in that the length of the service life of developer becomes one of the primary factors which determine the length of the maintenance interval.

From the standpoint of the workload of a service person, cost, and also, the length of the downtime of an image forming apparatus, the maintenance interval is desired to be as long as possible. Thus, a large amount of time and effort has been spent to develop a developer with a longer service life, and processes for preventing the developer deterioration. However, the reality is that the length of the service life of developer is equivalent to 30,000-50,000 sheets.

Thus, there has been proposed a developing apparatus which can be replenished with a developer to prevent the developer in the developing apparatus from deteriorating in the toner charging performance. More specifically, the developing apparatus is provided therein with a supply apparatus which supplies a fresh developer or carrier, and a developer overage resulting from the supply of developer or carrier by the supply apparatus is collected by allowing the developer to overflow through a developer discharge opening provided to a wall surface of the developing apparatus.

In other words, the deteriorated developer in the developing apparatus of this type is gradually replaced by fresh toner and carrier through the continual repetition of the process of supplying the apparatus with a fresh developer or carrier and the process of discharging the developer. As a result, a developing characteristic of the developer in the developing apparatus is kept constant, so that it is possible to maintain a charging characteristic of the developer to suppress a lowering in copied image quality. Thus, it is possible to extend the length of the developer replacement interval or eliminate the need for a service person or the like to replace the developer.

However, the above described constitution has been accompanied with the following problem.

The developer overage resulting from the supply of developer or carrier is discharged so as to overflow through the developer discharge opening provided to a side wall opposed to a screw, disposed in a developer container, for stirring and feeding (conveying) the developer in the developer container. An amount of discharge is determined by a position, a size, and a shape of the developer discharge opening for regulating an amount of the developer overage. However, irrespective of the position, the size, and the shape of the developer discharge opening, a necessary developer can also be discharged in addition to the developer overage by bumps of a blade of the screw in the developer container in an area opposing the developer discharge opening.

In order to solve this problem, Japanese Laid-Open Patent Application (JP-A) 2000-112238 has proposed a developing apparatus constituted so that a force acting on a developer in a circumferential direction or an outward radial direction by rotation of a screw located in an area opposing the developer discharge opening is smaller than those in other areas. As an embodiment in the developing apparatus, such a constitution that a blade of the screw located in the area opposing the developer discharge opening is reduced in size or omitted is shown.

However, according to study by the present inventor, it has been found that the following new problem occurs.

When the blade of the screw located in the area opposing the developer discharge opening is reduced in size or omitted, a feeding power (conveyance performance) of the screw in the area opposing the developer discharge opening is smaller than that of the screw in a downstream-side area of the developer discharge opening in a feeding direction of the developer. As a result, a part of the developer located in the area opposing the developer discharge opening is liable to remain in the opposing area, so that a top surface (level) of the developer is not stabilized. Therefore, unstable discharge of developer is repeated, so that a desired discharge characteristic cannot be obtained.

JP-A 2004-206088 has proposed that a difference in feeding power of a feeding screw for feeding a developer in a developer container is given.

More specifically, a developer feeding power of a feeding screw close to a discharge opening, provided to a developer container, for discharging developer overage resulting from supply of developer is made larger than those in a downstream-side area and upstream-side area of the developer discharge opening with respect to a developer feeding direction. By employing such a constitution, a top surface of developer at the discharge opening is lowered to gradually replace the developer automatically with fresh developer, so that the developer overage is intended to be sensitively discharged against an increase thereof.

However, in the developing apparatus disclosed in JP-A 2004-206088, the developer feeding power of the feeding screw close to the developer discharge opening is larger than that of the feeding screw in the downstream-side area of the discharge opening with respect to the developer feeding direction, so that it has been found that the following problem arises.

Due to a larger developer feeding power of the feeding screw in an area close to the developer discharge opening than that of the feeding screw in the downstream-side area of the discharge opening with respect to the developer feeding direction, the developer fed from the area close to the discharge opening is liable to remain in the downstream-side area of the discharge opening with respect to the developer feeding direction. This remaining developer leads to an unstable top surface of developer at the developer discharge opening. As a result, the sensitive discharge of developer against an increase of the developer overage can be inhibited.

SUMMARY OF THE INVENTION

In view of the above described circumstances, the present invention has been accomplished.

A principal object of the present invention to reduce an amount of developer discharged from a developer container in a bump manner by force acting on the developer during rotation of a feeding member in a developing apparatus for permitting discharge of developer from a discharge opening. Further, another object of the present invention is to eliminate unstable discharge of developer from a developer container caused due to remaining of developer in the neighborhood of a developer discharge opening.

A specific object of the present invention is to provide a developing apparatus capable of stabilizing a top surface (level) of developer in an area close to a developer discharge opening to permit stable discharge of the developer.

According to an aspect of the present invention, there is provided a developing apparatus comprising:

a developer container for containing a developer including a toner and a carrier;

a supply device for supplying a supply developer including a toner and a carrier to the developer container;

a discharge opening, provided to the developer container, for permitting discharge of the developer contained in the developer container; and a feeding member, disposed close to the discharge opening in the developer container, for feeding the developer, wherein the feeding member has a developer feeding power, in an opposing area in which the developer feeding member is opposed to the discharge opening, larger than that in an upstream-side area of the discharge opening with respect to a developer feeding direction, and wherein the feeding member has a developer feeding power, in a downstream-side area of the discharge opening with respect to the developer feeding direction, equal to or larger than that in the opposing area.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the developing apparatus in accordance with the present invention will be described with reference to the drawings.

Embodiment 1

Figure 1:
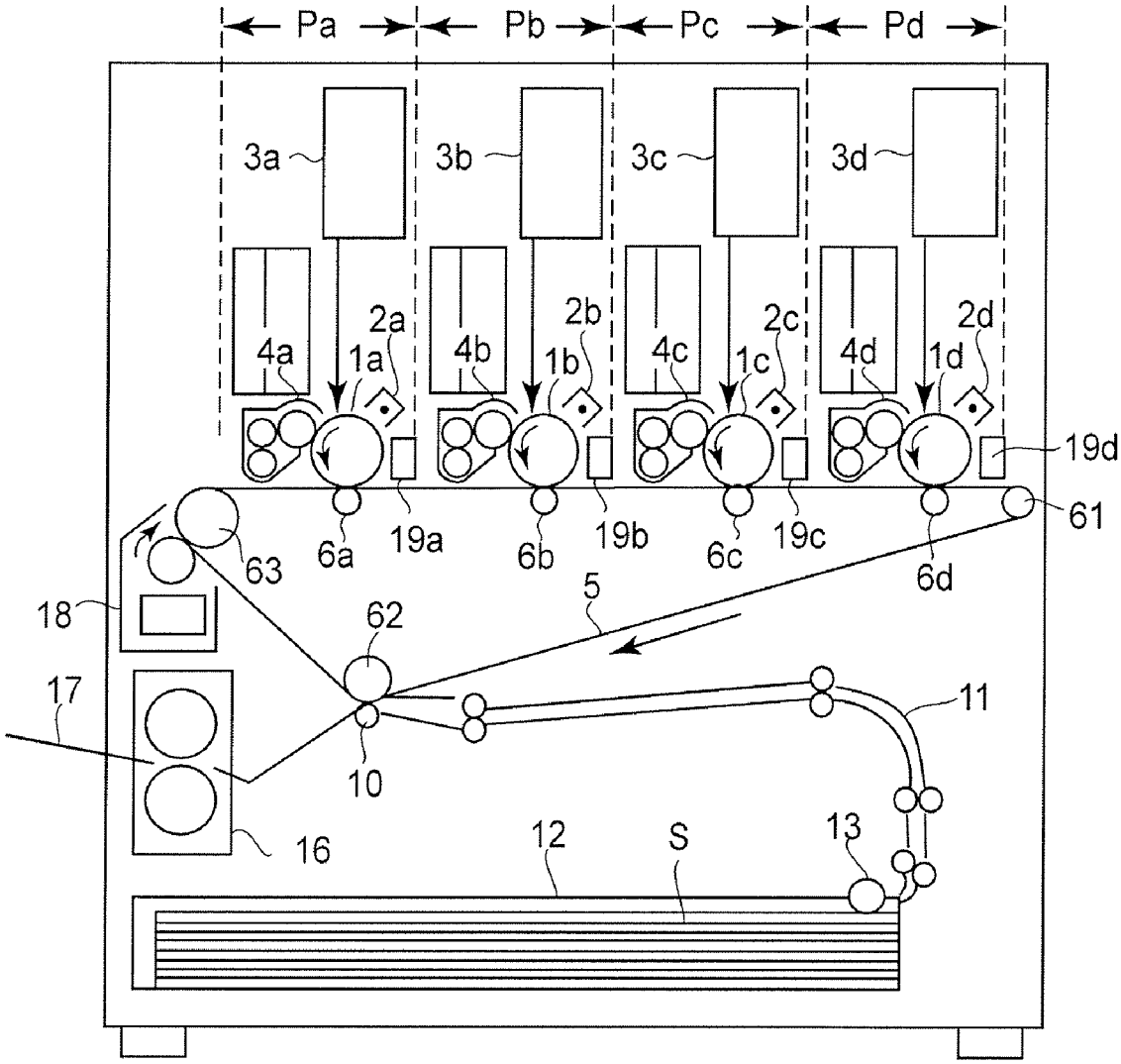
FIG. 1 is a schematic structural view showing an embodiment of an image forming apparatus including the developing apparatus according to the present invention.

FIG. 1 is a schematic drawing of the electrophotographic full-color image forming apparatus, as an example of an image forming apparatus including the developing apparatus of the present invention, showing the general structure thereof.

The image forming apparatus in this embodiment has four image forming portions P (Pa, Pb, Pc, and Pd). Each of the four image forming portions Pa-Pd has an electrophotographic photosensitive member as an image bearing member, in the form of a drum (hereinafter referred to as a "photosensitive drum"), which rotates in the direction indicated by an arrow (counterclockwise direction). Each image forming portion P has an image forming means comprising a charging device 2 (2*a*, 2*b*, 2*c*, and 2*d*) as a charging means, and a laser beam scanner 3 (3*a*, 3*b*, 3*c*, and 3*d*) as an exposing means disposed above the photosensitive drum 1. Further, the image forming means includes a developing apparatus 4 (4*a*, 4*b*, 4*c*, and 4*d*), a transfer roller 6 (6*a*, 6*b*, 6*c*, and 6*d*), a cleaning means 19 (19*a*, 19*b*, 19*c*, and 19*d*), etc., disposed around the photosensitive drum 1.

The four image forming portions Pa, Pb, Pc, and Pd are identical in structure. Further, the image forming means disposed at the image forming portions Pa, Pb, Pc, and Pd, respectively, are also identical in structure. Therefore, the photosensitive drums 1*a*, 1*b*, 1*c*, and 1*d*, the charging devices 2*a*, 2*b*, 2*c*, and 2*d*, the laser beam scanners 3*a*, 3*b*, 3*c*, and 3*d*, and the developing apparatuses 4*a*, 4*b*, 4*c*, and 4*d* will be referred to as photosensitive drum 1, charging device 2, laser beam scanner 3, and developing apparatus 4, respectively, in general terms.

Similarly, the transfer rollers 6*a*, 6*b*, 6*c*, and 6*d*, and the cleaning means 19*a*, 19*b*, 19*c*, and 19*d* will be referred to as transfer roller 6, and cleaning means 19, respectively, in general terms.

Next, the image formation sequence of the image forming apparatus constituted as described above will be described.

First, the photosensitive drum 1 is electrically charged uniformly by the charging device 2. The photosensitive drum 1 is rotated in the clockwise direction indicated by an arrow at a process speed (peripheral speed) of 273 mm/sec.

After being uniformly changed as described above, the photosensitive drum 1 is scanned by a beam of laser light projected, while being modulated with image (video) signals, from the abovementioned laser beam scanner 3 which internally holds a semiconductor laser. The semiconductor laser is controlled by the image signals modulated with image formation data outputted by an original reading apparatus having a photoelectric transducer such as a CCD, and outputs a beam of laser light.

A surface potential of the photosensitive drum 1 uniformly charged by the charging device 2 changes at an image portion. As a result, an electrostatic latent image is formed on the peripheral surface of the photosensitive drum 1. This electrostatic latent image is developed in reverse into a visible image, i.e., a toner image.

In this embodiment, the developing apparatus 4 employs a two-component developing method of a contact type, which uses a mixture of a toner and a carrier, as a developer.

The above described image formation sequence is carried out for each of the image forming portions Pa, Pb, Pc, and Pd. As a result, four images are formed of yellow, magenta, cyan and black toners, on the photosensitive drums 1*a*, 1*b*, 1*c*, and 1*d*, respectively.

In this embodiment, the image forming apparatus is provided with an intermediary transfer member 5, which is in the form of a belt (intermediary transfer belt), located below the image forming portions Pa, Pb, Pc, and Pd. The intermediary transfer belt 5 is extended around rollers 61, 62 and 63, and is rotatable in the direction indicated by an arrow.

The toner images on the photosensitive drums 1 (1*a*, 1*b*, 1*c*, and 1*d*) are temporarily transferred by the transfer rollers 6 (6*a*, 6*b*, 6*c*, and 6*d*) as a primary transferring means, respectively, onto the intermediary transfer belt 5 as an intermediary transfer member. As a result, four toner images of yellow, magenta, cyan, and black are deposited in layers on the intermediary transfer belt 5, thereby forming a full-color image on the intermediary transfer belt 5. As for the toner remaining on the photosensitive drum 1, that is, the toner which was not transferred onto the intermediary transfer belt 5, it is collected by the cleaning means 19.

The full-color image on the intermediary transfer belt 5 is transferred onto a recording medium (material) S such as paper. More specifically, the transfer medium S is drawn out of a sheet feeder cassette 12 by a feed roller 13, and is conveyed to the image transfer portion along a sheet guide 11. Then, as the recording medium S is conveyed through the image transfer portion, the full-color image is transferred onto the recording medium S by the function of a secondary transfer roller 10 as a secondary transferring means. The toner remaining on the surface of the intermediary transfer belt 5, that is, the toner which was not transferred onto the recording medium S, is collected by a cleaning means 18 for cleaning the intermediary transfer belt 5.

As for the transfer medium S onto which the toner images were transferred, it is sent to a fixing device 16 (fixing device of thermal roller type), in which the toner images are fixed to the recording medium S. Thereafter, the recording medium S is discharged into a delivery tray 17.

Incidentally, although, in this embodiment, the photosensitive drum 1, which is an ordinary organic photosensitive member in the form of a drum, is used as the image bearing member, an inorganic photosensitive member such as a photosensitive member formed of amorphous silicon or the like may also be used. Further, it is also possible to use a photosensitive member in the form of a belt.

As for the charging method, transferring method, cleaning method, and fixing method, they also do not need to be limited to those described above.

Figure 2:
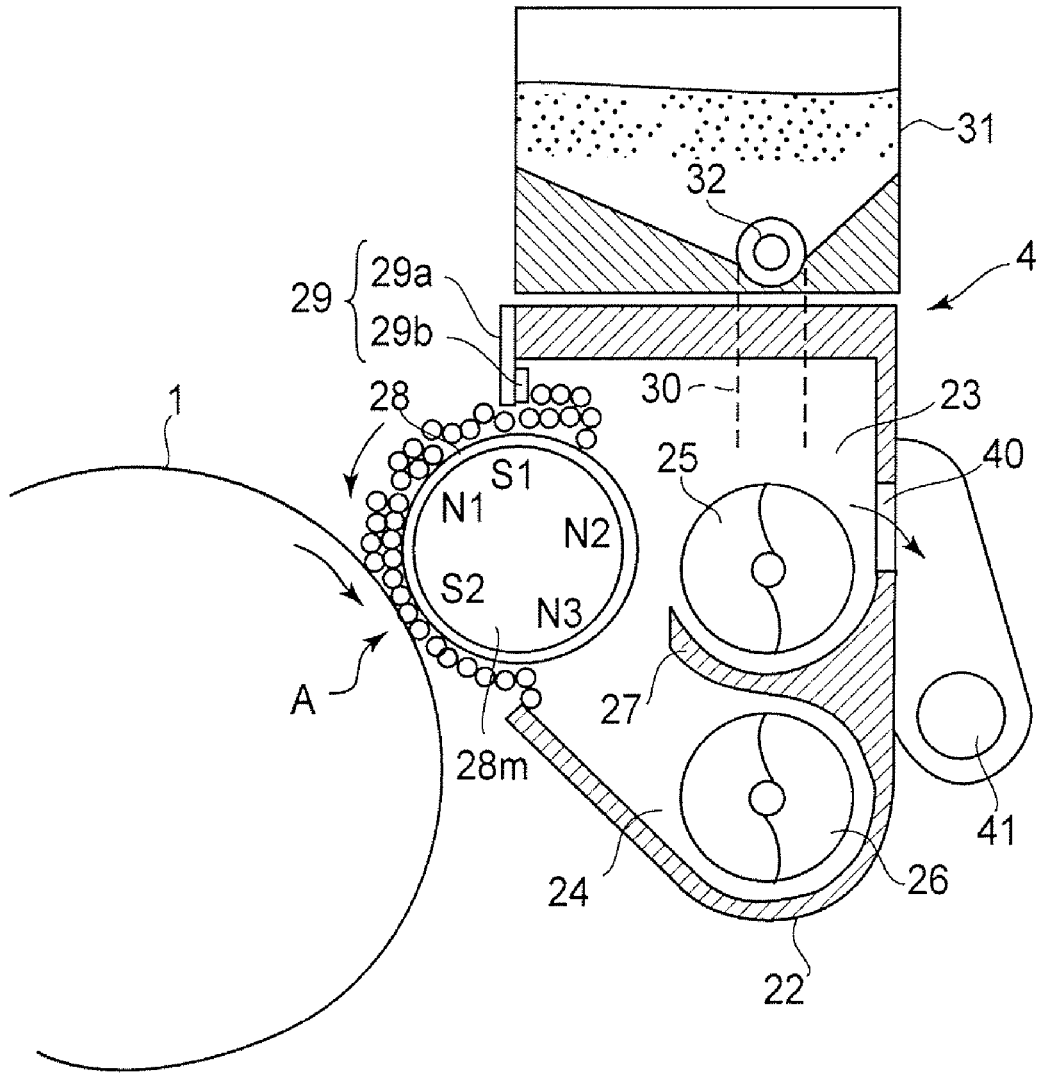
FIG. 2 is a schematic cross-sectional view showing an embodiment of the developing apparatus of the present invention.
Figure 3:
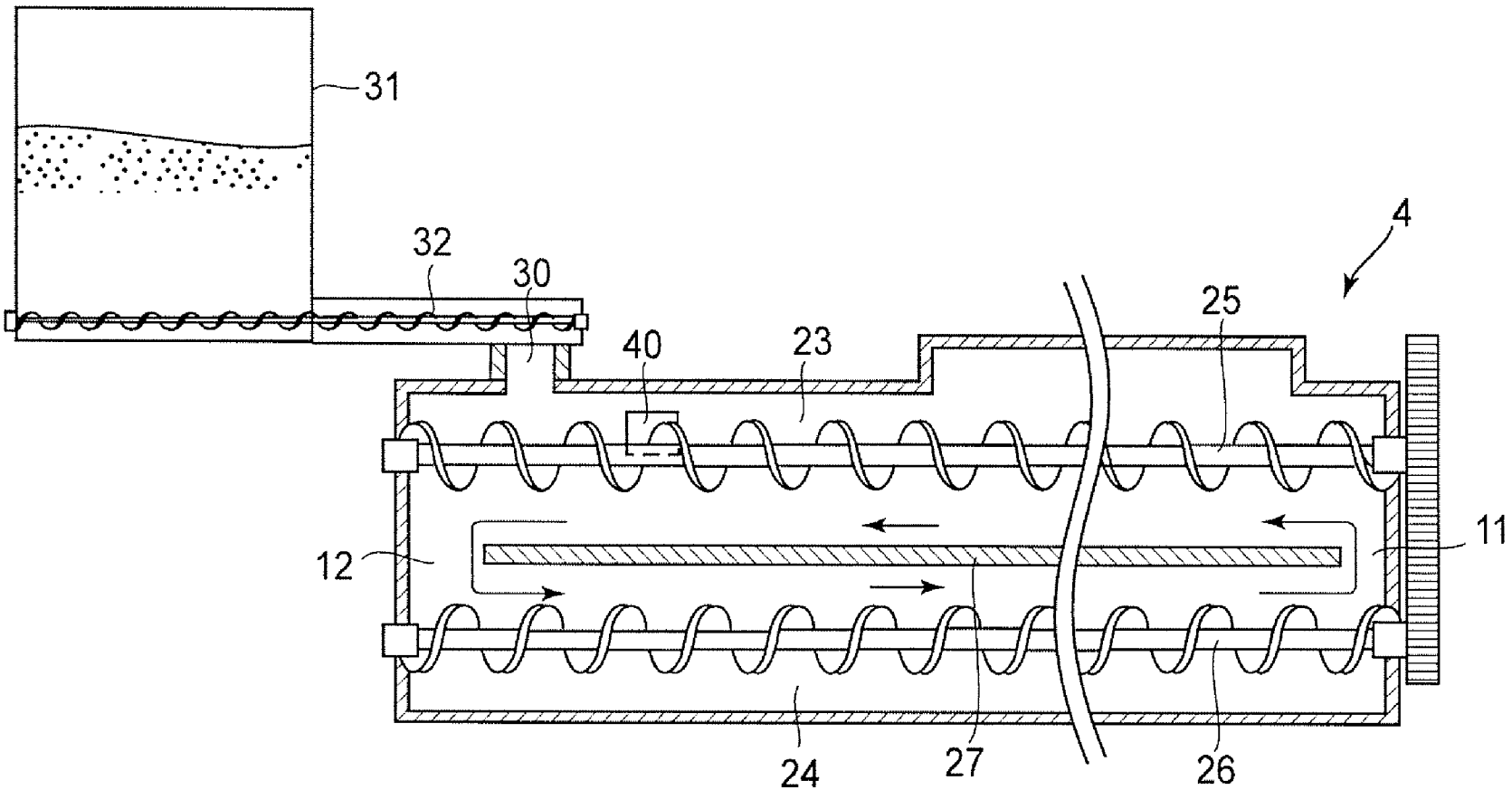
FIG. 3 is a longitudinal sectional view showing an embodiment of the developing apparatus of the present invention.

Next, referring to FIGS. 2 and 3, the operation of the developing apparatus 4 will be described. FIGS. 2 and 3 are sectional views of the developing apparatus 4 in this embodiment.

The developing apparatus 4 in this embodiment has a developer container 22, in which a two-component developer including a toner and a carrier is stored. The developing apparatus 4 also includes a development sleeve 28 as a developer bearing means and a trimming member 29 for regulating the magnetic brush formed of the developer borne on the peripheral surface of the development sleeve 28, in the developer container 22.

In this embodiment, the internal space of the developer container 22 is horizontally divided by a partitioning wall 27, into a development chamber 23 (upper chamber) and stirring chamber 24 (lower chamber). The partitioning wall 27 extends in the direction perpendicular to the drawings of FIGS. 2 and 3. The developer is stored in the development chamber 23 and the stirring chamber 24.

In the development chamber 23 and stirring chamber 24, first and second conveyance (feeding) screws 25 and 26 (conveyance or feeding members), as means for conveying or feeding the developer while stirring it, are disposed, respectively. The first conveyance screw 25 is disposed in the bottom portion of the development chamber 23, roughly in parallel to the axial direction of the development sleeve 28. It conveys the developer in the development chamber 23 in one direction parallel to the axial line of the development sleeve 28 by being rotated. The second conveyance screw 26 is disposed in the bottom portion of the stirring chamber 24, roughly in parallel to the first conveyance screw 25. It conveys the developer in the stirring chamber 24 in the direction opposite to the direction in which the developer in the development chamber 23 is conveyed by the first conveyance screw 25. With the first and second conveyance screws 25 and 26 conveying the developer as described above, the developer in the developer container 22 is circulated between the development chamber 23 and stirring member 24 through openings or gaps 11 and 12 (that is, developer communicating passages) present between both ends of the partitioning wall 27 and the corresponding end walls of the developer container 22, one for one.

In this embodiment, the development chamber 23 and stirring chamber 24 are vertically stacked. However, the present invention is also applicable to a developing apparatus conventionally used widely in which the development chamber 23 and stirring chamber 24 are horizontally disposed and developing apparatuses of other types.

In this embodiment, the developer container 22 is provided with an opening in a developing area A wherein the developer container 22 and photosensitive drum 1 are located opposite to each other. The development sleeve 28 is rotatably attached to the developer container 22, being partially exposed from the developer container 22 toward the photosensitive drum 1 through this opening.

The diameters of the development sleeve 28 and photosensitive drum 1 are 20 mm and 80 mm, respectively, and the smallest distance between the peripheral surfaces of the development sleeve 28 and photosensitive drum 1 is set to be roughly 400 μm so that development can be effected in a state in which the developer conveyed to the developing area A is brought into contact with the photosensitive drum 1.

The development sleeve 28 is formed of nonmagnetic material such as aluminum and stainless steel and internally holds a magnetic roller 28*m* as a magnetic field generating means, which is non-rotationally disposed within the magnetic roller 28*m*. This magnetic roller 28*m* has a development pole S2 facing the portion of the photosensitive drum 1 in the developing area A, a magnetic pole S1 facing the magnetic brush trimming member 29, a magnetic pole N1 positioned between the magnetic poles S1 and S2, and magnetic poles N2 and N3 facing the development chamber 23 and stirring chamber 24, respectively.

In the constitution described above, the development sleeve 28 is rotated in the direction indicated by an arrow (counterclockwise direction) to carry the two-component developer regulated in its layer thickness by the magnetic brush trimming member 29. Then, the development sleeve 28 conveys the layer thickness-regulated two-component developer to the development area A in which the development sleeve 28 and photosensitive drum 1 are located opposite to each other. As a result, the two-component developer is supplied to the electrostatic latent image formed on the peripheral surface of the photosensitive drum 1, thus developing the latent image. During this process of developing the latent image, in order to improve development efficiency, that is, the efficiency with which the toner is imparted to the latent image, development bias comprising DC voltage biased or superposed with AC voltage, is applied to the development sleeve 28 from the electrical power source. In this embodiment, the development bias is a combination of a DC voltage of −500 V, and an AC voltage which is 1,800 V in peak-to-peak voltage Vpp and 12 kHz in frequency. However, the voltage value of DC voltage and waveform of AC voltage do not need to be limited to those described above.

In the two-component magnetic brush developing method, generally, the application of AC voltage increases development efficiency, improving thereby image quality. On the other hand, it is likely to cause fog. Therefore, the potential level of the DC voltage applied to the development sleeve 28 is made different from the potential level to which the photosensitive drum 1 is electrically charged (that is, potential level of white background portion) to prevent occurrence of fog.

The regulating blade 29 as the above-mentioned trimming member is made up of a nonmagnetic member 29*a*, and a magnetic member 29*b*. The nonmagnetic member 29*a* is formed of an aluminum plate or the like and extends in the longitudinal direction parallel to the axial direction of the development sleeve 28. The magnetic member 29*b* is formed of iron or the like. The regulating blade 29 is disposed upstream of the photosensitive drum 1 in the rotational direction of the development sleeve 28. Both the toner and carrier of the developer are sent to the development area A through the gap between the trimming member 29 and the development sleeve 28. The amount by which the developer is conveyed to the development area A is adjusted by the amount of the gap between the regulating blade 29 and the peripheral surface of the development sleeve 28. In this embodiment, the amount per unit area, by which the developer is coated on the peripheral surface of the development sleeve 28, is regulated to 30 mg/cm$^2$ by the regulating blade 29.

The gap between the regulating blade 29 and development sleeve 28 is set to a value in the range of 200-1,000 μm, preferably, 300-700 μm. In this embodiment, it is set to 500 μm.

The development sleeve 28 of the developing apparatus 4, and the photosensitive drum 1, are driven in the directions so that their peripheral surfaces move in the same direction in the development area A. As for the ratio of the peripheral speed of the development sleeve 28 relative to that of the photosensitive drum 1, it is set to 1.75. It does not need to be set to 1.75, as long as it is set to a value in the range of 0-3.0, preferably, 0.5-2.0. As the ratio increases, the development efficiency increases. However, when the ratio is excessively large, problems such as toner scattering and developer deterioration occur. Therefore, the ratio is desired to be set to a value in the above-mentioned range.

Next, the two-component developer used in this embodiment, which comprises primarily the toner and the carrier, will be described.

The toner contains primarily bonding resin, and coloring agent. If necessary, particles of coloring resin, inclusive of additives, and coloring particles having external additive such as fine particles of colloidal silica, are externally added to the toner. The toner used in this embodiment is a negatively chargeable resinous toner formed of polyester or the like, and is desired to be not less than 4 μm and not more than 10 μm, preferably not more than 8 μm, in volume-average particle size.

As for the material for the carrier, particles of iron, the surface of which has been oxidized or has not been oxidized, nickel, cobalt, manganese, chrome, rare-earth metals, alloys of the preceding metals, or ferrous oxide, are preferable. The method of producing the magnetic particles is not particularly limited. A weight-average particle size of the carrier is desired to be in the range of 20-60 μm, preferably, 30-50 μm. The carrier is desired to be not less than $10^7$ ohm·cm, preferably, not less than $10^8$ ohm·cm, in resistivity. In this embodiment, the carrier with a resistivity of $10^8$ ohm·cm is used.

The volume-average particle size of the toner used in this embodiment was measured using the following apparatus and method. As the measuring apparatus, a Coulter Counter T-II (mfd. by Coulter Co. Ltd.), an interface (mfd. by Nikkaki Bios Co., Ltd.) for outputting number average distribution and volume-average distribution, a personal computer (Model "CX-1", available from CANON K.K.) were used. As the electrolytic solution, a 1%-aqueous solution of reagent-grade sodium chloride was used.

The measuring method was as follows. To 100-150 ml of the electrolytic solution, 0.1 ml of a surfactant as a dispersant, preferably, alkylbenzenesulfonic acid salt, was added, and to this mixture, 0.5-50 mg of test sample was added.

Then, the electrolytic solution in which the test sample was suspended was placed in an ultrasonic dispersing device for roughly 1-3 minutes to disperse the test sample. Then, the particle size distribution of the toner particles, the size of which is in the range of 2-40 μm was measured with the use of the abovementioned Coulter Counter TA-II fitted with a 100 μm aperture, and volume average distribution was obtained. Then, a volume-average particle size was obtained from the volume-average distribution obtained through the above described process.

The resistivity of the carrier in this embodiment was measured in the following manner. The sample was placed in a cell of the sandwich type with a measurement electrode area of 4 cm$^2$ and an electrode gap of 0.4 cm, and voltage E (V/cm) was applied between two electrodes while applying 1 kg of weight (load) to one of the electrodes, to obtain the resistivity of the carrier from the amount of the current which flowed through the circuit.

Next, referring to FIGS. 2 and 3, the method, in this embodiment, for supplying (replenishing) the developing apparatus with developer will be described.

The developing apparatus 4 is provided, at its upper portion, with a hopper 31 for replenishing the developing apparatus 4 with a two-component supply developer comprising a mixture of a toner and a carrier. The hopper 31, which constitutes the toner supplying means, is provided with a supply member, i.e., a supply screw 32, which is disposed at a lower portion of the hopper 31. One end of the supply screw 32 extends to a developer supply opening 30 of the developer container 22, which is located near the front end of developing apparatus 4.

The developer container 22 is supplied with the toner, by the amount equal to the amount of the toner consumed for image formation, from the hopper 31 through the developer supply opening 30 by a rotational force of the supply screw 32 and the weight of the developer itself. In this manner, the supply developer is supplied from the hopper 31 to the developing apparatus 4.

The amount by which the supply developer is supplied to the developer container 22 can be roughly determined by the number of revolutions of the supply screw 32, and the number of revolutions is controlled by an unshown toner supply amount controlling means. As for the method for controlling the toner supply amount, it may be appropriately selected from among the various methods, which have been known; for example, a method in which the toner density of the two-component developer is optically or magnetically detected, a method in which the density of a toner image formed by developing a referential latent image formed on the peripheral surface of the photosensitive drum 1 is detected, etc.

Next, referring to FIGS. 2 and 3, the method, in this embodiment, for discharging the developer will be described.

The developing apparatus 4 is provided with a developer discharge opening 40 as a developer discharging means, which is in one of the walls of the developing apparatus 4. The deteriorated developer is discharged in the direction indicated by an arrow through this developer discharge opening 40 as shown in FIG. 2. As the amount of the developer in the developing apparatus 4 increases due to the execution of the process of supplying the developer, the developer is discharged, that is, allowed to overflow, through the developer discharge opening 40 by the amount proportional to the amount of the increase. The discharged developer is conveyed by collecting screw 41 as a collecting member to an unshown storage bin for the collected developer.

As for the positioning of the developer discharge opening 40, the developer discharge opening 40 is located upstream of the developer supply opening 30 as shown in FIG. 3, in order to prevent the fresh supply developer from being immediately discharged.

Figure 4:
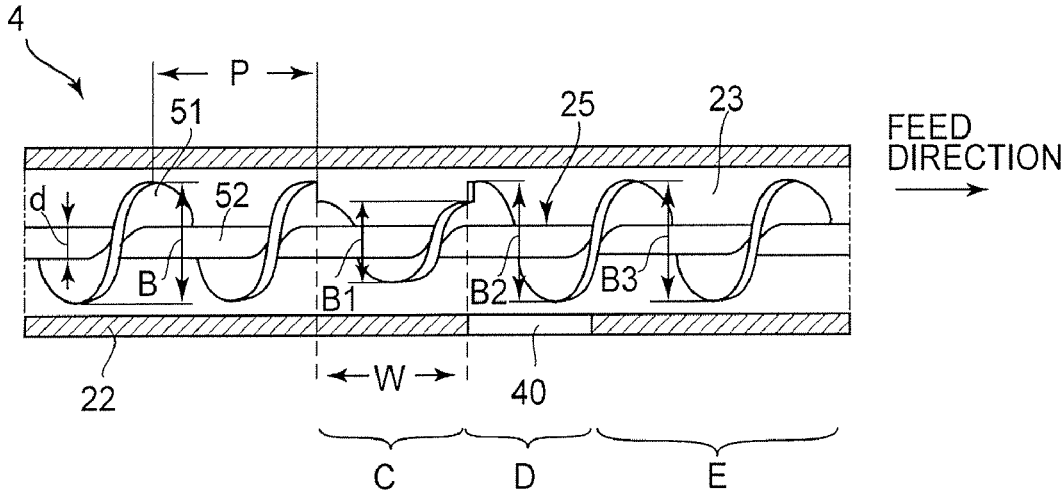
FIGS. 4, 5, 6(*a*), 6(*b*), 7(*a*), 7(*b*), 8(*a*), 8(*b*), 9(*a*), 9(*b*), 10(*a*), and 10(*b*) are schematically enlarged views each for illustrating a portion, opposing a developer discharge opening, of a feeding member disposed in a developer container in an embodiment of the developing apparatus according to the present invention.

With reference to FIG. 4, a constitution of a first conveyance screw (feeding screw) in the neighborhood of the developer discharge opening 40 as a characteristic feature of the present invention will be described.

FIG. 4 is a schematic view of a first conveyance screw 25 located in the neighborhood of the developer discharge opening 40 in the development chamber 23 of the developing apparatus 4 as viewed from above.

The first conveyance screw 25 is constituted by a rotation shaft (rotational axis) 52 having a shaft diameter (d) of 8 mm and a stirring blade, i.e., a screw blade 51 as a helical blade portion, which helically extends uniformly in a direction of the rotational axis and has a pitch (p) of 30 mm and an outer diameter (B) of 28 mm. A second conveyance screw 26 has the same constitution as that of the first conveyance screw 25.

A feature of this embodiment is that the outer diameter (B) of the blade 51 of the first conveyance screw 25 is small, i.e., B1=14 mm in an upstream apparatus C of the developer discharge opening 40 with respect to a developer feeding direction (conveyance direction). On the other hand, in an opposing area D where the first conveyance screw 25 is opposed to the developer discharge opening 40, the outer diameter (B) of the blade 51 is not changed, i.e., remains at 28 mm (B2=B). Further, although details are described later, an outer diameter (B3) in a downstream area E of the developer discharge opening 40 with respect to the developer feeding direction can also be 28 mm (B=B3).

Therefore, a feeding power (conveyance performance) of the blade 51 of the first conveyance screw 25 with respect to the developer feeding direction is once decreased in the upstream area C of the developer discharge opening 40 and then increased in the opposing area D with respect to the developer discharge opening 40.

As a result, the developer is liable to remain in the upstream area C of the developer discharge opening 40 with respect to the developer feeding direction, so that feeding of the developer in a downstream direction is liable to stagnate. Consequently, a top surface (level) of developer is lowered in the opposing area developer with respect to the developer discharge opening 40. The lowering in the top surface of developer means that an amount of developer remaining on the blade of the first conveyance screw 25 is decreased in the discharge opening opposing area D, so that it is possible to decrease an amount of developer discharged through the developer discharge opening 40 in a bump manner by rotation of the first conveyance screw 25.

As described above, in this embodiment, the outer diameter (B1) of the blade 51 of the first conveyance screw 25 in the upstream area C of the developer discharge opening 40 with respect to the developer feeding direction is decreased, so that the amount of developer remaining on the blade 51 is decreased. As a result, the developer feeding power of the first conveyance screw 25 is decreased. In this case, it is possible to decrease more effectively the amount of developer remaining on the blade 51 of the first conveyance screw 25 in the opposing area D with respect to the developer discharge opening 40. A decease in degree of bumps of developer by the blade 51 of the first conveyance screw 25 is largely affected by the decrease in amount of developer remaining on the blade 51 of the first conveyance screw 25. For this reason, by the above described constitution employed in this embodiment, it is possible to decrease more effectively the amount of developer discharged in a bump manner by the rotation of the first conveyance screw 25.

In this embodiment, a width (W) in the upstream area C in which the outer diameter of the blade 51 of the first conveyance screw 25 is decreased is 10 mm. The width (W) of 10 mm is sufficient from the viewpoint of an effect of the present invention and is not required to be further increased. Even when the width (W) is further increased, a similar effect can be attained. However, a conveyance performance of developer is lowered in the width area, so that a problem in terms of conveyance of developer can occur when the width (W) is excessively increased.

On the other hand, when the width (W) of the upstream area C described, in outer diameter of the blade 51 is excessively decreased, a sufficient effect is not attained in some cases although an improvement effect is obtained.

The width (W) of the upstream area C may preferably be set in a range of 3-30 mm, more preferably 5-15 mm, depending on a pitch (interval) P of the conveyance screw or the like.

In this embodiment, the area C in which the outer diameter of the blade 51 of the first conveyance screw 25 is decreased is provided immediately in front of the developer discharge opening 40, i.e., immediately upstream of the developer discharge opening 40. This is because it is possible to decrease the amount of developer remaining on the conveyance screw in the area D in which the conveyance screw is opposed to the developer discharge opening 40 by providing the area C at a position immediately upstream of the developer discharge opening 40, so that it is possible to suppress the discharge of developer in a bump manner by the blade.

The position of the area C decreased in conveyance performance may preferably be immediately before the developer discharge opening 40 but an improvement effect can be attained so long as the area C is provided in any area located within two pitches (2×P) in terms of the blade 51 of the first conveyance screw 25 or 50 mm from a closer end of the developer discharge opening 40 on the upstream side of the developer discharge opening 40 with respect to the developer feeding direction. In a preferred embodiment, the area C is provided in an area located within one pitch (in terms of the blade 51 of the first conveyance screw 25) or 25 mm from the closer end of the developer discharge opening 40 on an immediately upstream side of the developer discharge opening 40. The area C decreased in conveyance performance may overlap with the opposing area D with respect to the developer discharge opening 40. In this case, however, unless an average feeding power (conveyance performance) of the conveyance screw in the upstream area C of the developer discharge opening 40 with respect to the developer feeding direction is smaller than that of the conveyance screw in the opposing area D with respect to the developer discharge opening 40, stagnation of developer is liable to occur in the opposing area D with respect to the developer discharge opening 40.

Further, a width (length) of overlapping of the upstream area C with the opposing area D may preferably be small, e.g., 5 mm or less, and more preferably 1 mm or less. Alternatively, no overlapping is preferred.

As described above, the constitution capable of attaining the effect of the present invention is such that the average developer feeding power of the conveyance screw 25 in the upstream area C of the developer discharge opening 40 with respect to the developer feeding direction is smaller than that in the opposing area D closest to the developer discharge opening 40.

In this case, the feeding direction of the conveyance screw can be defined as a product of a volume, obtained by an integral of one pitch of the screw blade with one rotation of the screw, multiplied by a conveyance speed of developer by the screw and a developer conveyance efficiency of the screw. More specifically, the feeding power of the conveyance screw is represented by the following equation:

$$\text{Feeding power}=\Pi\times\{(\text{outer diameter of screw blade})^2-(\text{shaft diameter of screw})^2\}\times(\text{pitch of screw})\times(\text{rotation speed of screw})\times(\text{developer conveyance efficiency})$$

Based on this equation, an average feeding power in the opposing area D with respect to the developer discharge opening 40 and an average feeding power in the upstream area C of the developer discharge opening 40 are calculated and compared. In this case, the average feeding power in the upstream area C of the developer discharge opening 40 may be calculated with respect to a large area selected from an area with the two pitches of screw and an area with a width of 50 mm. This is because, as described above, the amount of developer in the opposing area D with respect to the developer discharge opening 40 is little affected even when a feeding power in an area upstream of the above described upstream area C is decreased.

Here, the feeding power obtained through the above described equation may be calculated by taking the developer conveyance efficiency as 80%. However, in the case of a screw provided with a stirring rib 53 (FIG. 10) as described later in another embodiment, the feeding power is taken as 60%.

In this embodiment, a feeding power of the first conveyance screw 25 in a downstream area E of the developer discharge opening 40 is larger than or equal to the feeding power of the first conveyance screw 25 in the opposing area D.

More specifically, when the feeding power in the downstream area E is lower than that in the opposing area D, the developer is liable to stagnate in the downstream area E. When a degree of the stagnation of developer in the downstream area E is considerably increased, the developer is increased in amount also in the opposing area D, with respect to the developer discharge opening 40, upstream of the downstream area E, so that the developer can also start to stagnate in the opposing area D. When such a state is caused to occur, there is a possibility of an increase in amount of developer discharged in a bump manner by the rotation of the conveyance screw 25.

For this reason, it is preferable that the feeding power of the conveyance screw 25 in the downstream area E is not smaller than that in the opposing area D with respect to the developer discharge opening 40.

On the other hand, the feeding power of the conveyance screw 25 in the downstream area E may be larger than that in the opposing area D with respect to the developer discharge opening 40. This is because stagnation of developer in the downstream area E is eliminated by increasing the feeding power of the conveyance screw 25 in the downstream area E compared with that in the opposing area D, so that a top surface of developer in the discharge opening opposing area D is stabilized.

However, there is no considerable advantage in the increase in feeding power of the conveyance screw 25 in the downstream area E, so that if the feeding power of the conveyance screw 25 in the downstream area E can be increased, the feeding power of the conveyance screw 25 in the discharge opening opposing area D may preferably be correspondingly increased.

Accordingly, when the average feeding power of the conveyance screw 25 in the downstream area E is equal to or larger the average feeding power of the conveyance screw 25 in the discharge opening opposing area D, there is no problem. These average feeding powers may be calculated according to the above described equation. In this case, the average feeding power in the downstream area E may be calculated in a larger area of an area with a width corresponding to two pitches and an area with a width of 50 mm, on the basis of a downstream end of the developer discharge opening 40 with respect to the developer feeding direction.

In this embodiment, the blade 51 of the conveyance screw 25 in the discharge opening opposing area D has the outer diameter B2 equal to the outer diameter B3 thereof in the downstream area E of the developer discharge opening 40 (i.e., B2=B3=B) and has the same (average) feeding power (conveyance performance) as that in the downstream area E.

According to the above described constitution, the amount of developer remaining on the blade 51 of the conveyance screw 25 is decreased in the opposing area D without decreasing the screw outer diameter (B2) in the opposing area D with respect to the developer discharge opening 40, so that it is possible to lower an amount of developer discharged due to bumps by the blade 51.

According to this embodiment, the screw outer diameter (B2) in the discharge opening opposing area developer is not required to be decreased, so that a degree of the above described stagnation of developer in the discharge opening opposing area D is low. As a result, it is also possible to suppress unstable discharge of developer from the developer discharge opening 40.

Embodiment 2

Figure 5:
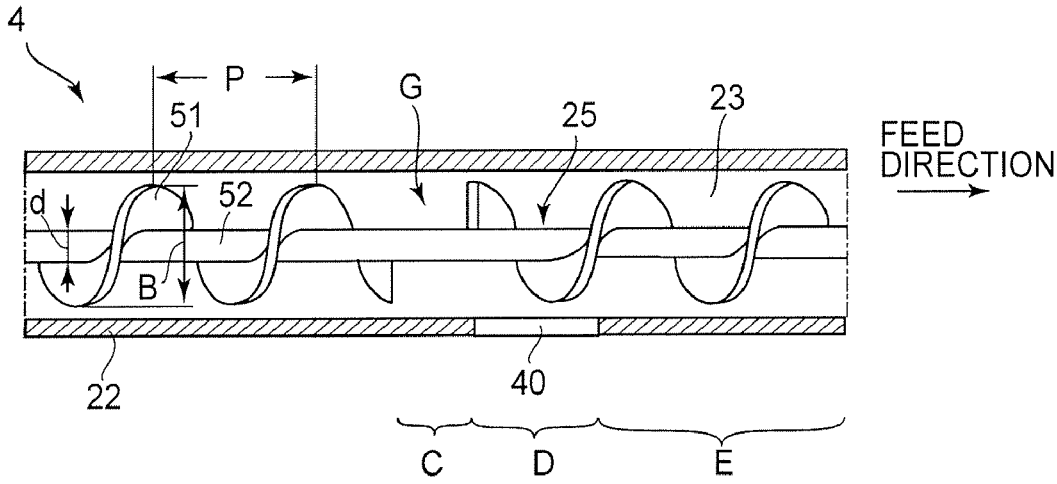

FIG. 5 is a schematic view of a first conveyance screw 25 in the neighborhood of a developer discharge opening 40 in a development chamber 23 of a developing apparatus 4 according to this embodiment of the present invention as viewed from above.

In the following description, constituents corresponding to those in Embodiment 1 are represented by identical reference numerals or symbols and detailed explanations thereof will be omitted.

The first conveyance screw 25 in this embodiment has the same constitution as in Embodiment 1 except for the following point.

As shown in FIG. 5, the first conveyance screw 25 in this embodiment has no blade 51 (i.e., the blade 51 is cut) in an immediately upstream area C of the developer discharge opening 40 with respect to the developer feeding direction. For this reason, a feeding power of the first conveyance screw 25 in the upstream area C with respect to the developer feeding direction is small, so that for the same reason as in Embodiment 1, a top surface (level) of developer in an opposing area D with respect to the developer discharge opening 40 is lowered.

The lowering in the developer top surface means that an amount of developer remaining on the blade 51 of the first conveyance screw 25 is decreased in the discharge opening opposing area D, so that it is possible to decrease an amount of developer discharged through the developer discharge opening 40 in a bump manner by rotation of the first conveyance screw 25.

Accordingly, also in this embodiment, the same action (function) as in Embodiment 1 is achieved.

In this embodiment, by decreasing the amount of developer remaining on the screw blade by omission of the blade 51 of the conveyance screw 25 in the upstream area C, the developer feeding power is lowered similarly as in Embodiment 1. For this reason, the amount of developer remaining on the blade 51 of the first conveyance screw 25 in the opposing area D with respect to the developer discharge opening 40 can be further decreased, so that it is possible to suppress the discharge of developer due to bumps of developer by the screw blade in the discharge opening opposing area D.

Particularly, when the blade is partially omitted as in this embodiment, the developer remaining on the blade is once removed completely in the immediately upstream area C of the developer discharge opening 40, so that the amount of developer remaining on the blade 51 of the conveyance screw 25 is considerably decreased. Thus, this embodiment is more effective.

Figure 6:
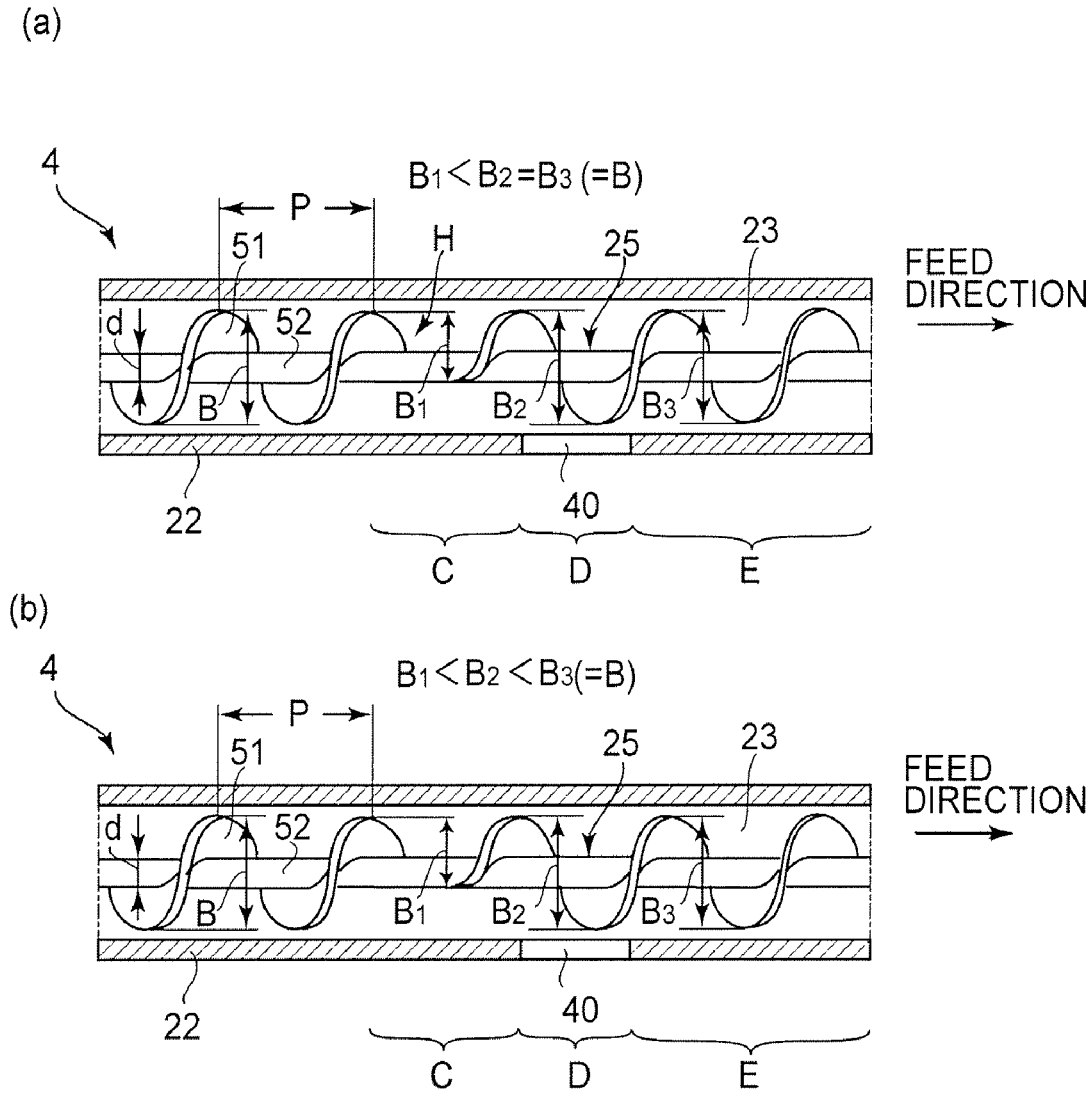

As for the omission of the blade, in addition to the method of completely omitting the blade as shown in FIG. 5, it is also possible to employ a constitution as shown in FIG. 6(*a*). More specifically, the constitution shown in FIG. 6(*a*) is such that in a predetermined area H, the outer diameter of the blade 51 is gradually decreased from B to B1 and the blade 51 is then completely omitted before the developer discharge opening 40 and thereafter is gradually increased in outer diameter of blade until the blade outer diameter is returned to the original outer diameter in the order of zero, B1, B2, and B3 (B2=B3=B). Also in this constitution, it is possible to achieve the same effect as in Embodiment 1. Further, this embodiment has such an advantage that a change in developer top surface is not caused abruptly, so that compared with Embodiment 1, it is also possible to further improve a developer stirring ability.

Figure 7:
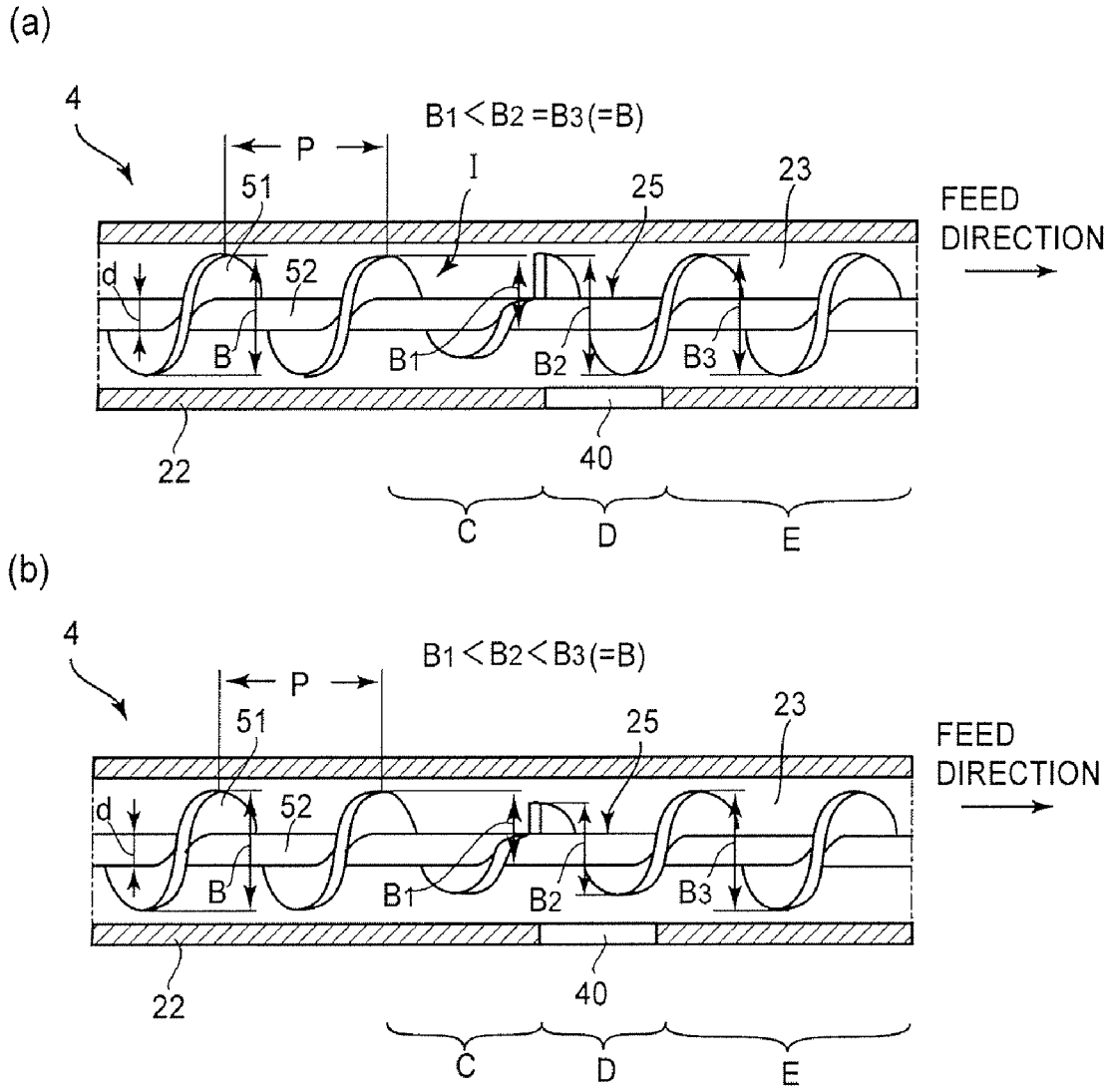

Further, as shown in FIG. 7(*a*), in a predetermined area I, the blade outer diameter is gradually decreased from B to B1 and then the blade is completely omitted and thereafter is abruptly increased in blade outer diameter to B2 at a position immediately upstream of the developer discharge opening 40*m*, thus resulting in B3 (B2=B3=B). Also in this case, there is such an advantage that an abrupt change in developer top surface is not caused. In addition, it is possible to decrease the amount of developer remaining on the screw blade in the discharge opening opposing area D as small as possible.

In this embodiment, similarly as in Embodiment 1, the feeding power of the conveyance screw 25 in the downstream area E of the developer discharge opening 40 is larger than or equal to that in the discharge opening opposing area D.

As described above, in this embodiment, as shown in FIGS. 6(*a*) and 7(*a*), the outer diameter B2 of the blade 51 in the discharge opening opposing area D is equal to the outer diameter B3 of the blade 51 in the downstream area E of the developer discharge opening 40, i.e., B2=B3, and the (average) feeding power in the opposing area D is also equal to the (average) feeding power in the downstream area E. In other words, the blade outer diameters in this embodiment in three areas satisfy the following relationship:

$B1$ (blade outer diameter in upstream area $C$)$<B2$
(blade outer diameter in opposing area $D$)$=B3$
(blade outer diameter in downstream area $E$).

In this case, the blade outer diameter B3 is equal to a basic outer diameter B of the blade, i.e., B2=B3=B.

The blade outer diameter B can also be modified as shown in FIG. 6(*b*) and FIG. 7(*b*).

More specifically, as shown in FIG. 6(*b*), the blade outer diameter B of the blade 51 is gradually increased from a left side to a right side on the drawing, i.e., in the order of the discharge opening upstream area C, the discharge opening opposing area D, and the discharge opening downstream area E. In other words, the blade outer diameters in these three areas, C, D and E satisfy the following relationship:

$B1$ (blade outer diameter in upstream area $C$)$<B2$
(blade outer diameter in opposing area $D$)$<B3$
(blade outer diameter in downstream area $E$),
wherein the blade outer diameter $B3$ is equal to
the basic outer diameter $B$, i.e., $B3=B$.

Further, as shown in FIG. 7(*b*), in the upstream area C of the developer discharge opening 40 with respect to the developer feeding direction, the blade outer diameter is gradually decreased from B to B1 and further decreased to zero, i.e., the blade is completely omitted, and then is abruptly increased up to B2 at a position immediately upstream of the developer discharge opening 40. Thereafter, in the discharge opening opposing area D and the downstream area E, the blade outer diameter is gradually increased from B2 to B3. In other words, the three outer diameters B1, B2 and B3 satisfy the relationship: B1<B2<B3 wherein the blade outer diameter B3 is equal to the basic blade outer diameter B, i.e., B3=B.

Embodiment 3

Figure 8:
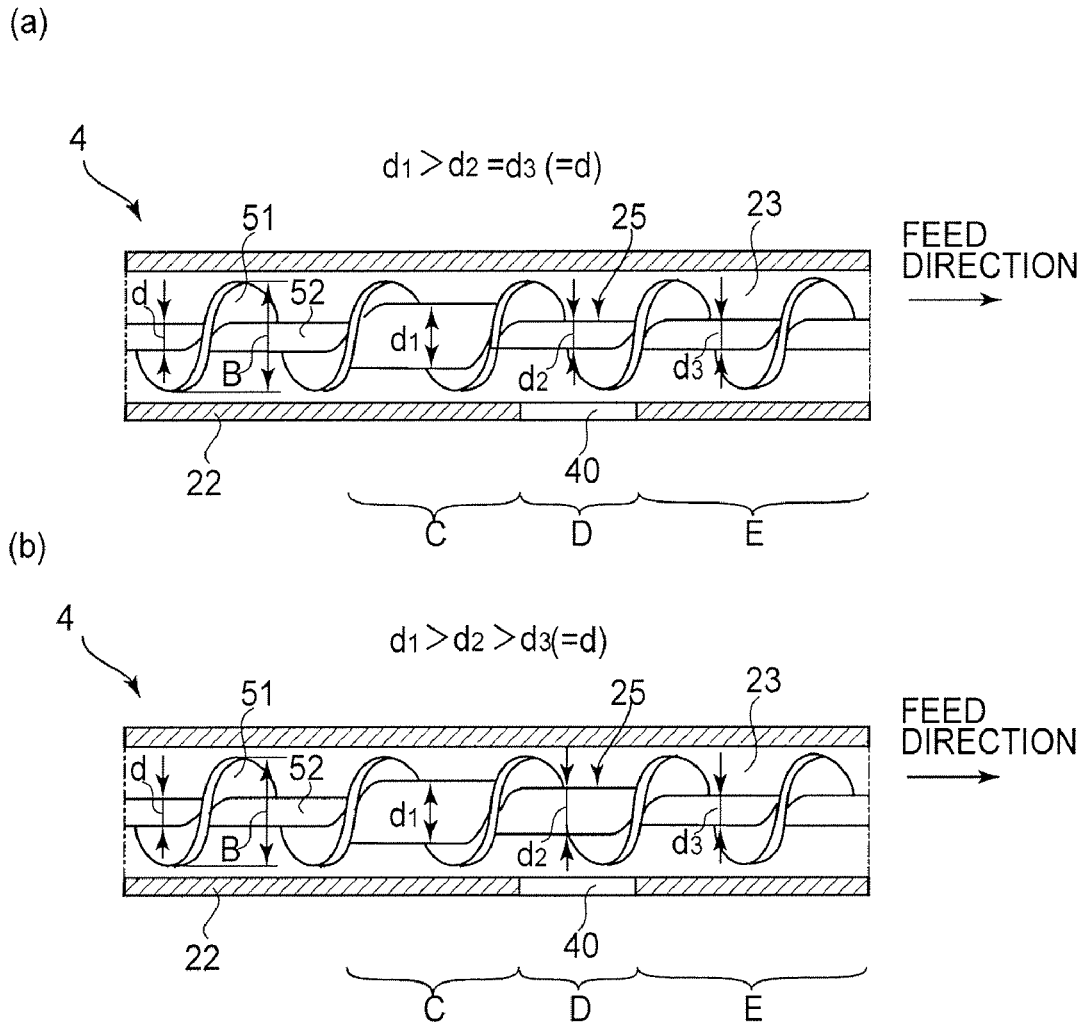

FIGS. 8(*a*) and 8(*b*) are schematic views each showing a first conveyance screw 25 in the neighborhood of a developer discharge opening 40 in a development chamber 23 of a developing apparatus 4 according to this embodiment of the present invention as viewed from above. In the following description, constituents corresponding to those in Embodiment 1 are represented by identical reference numerals or symbols and detailed explanations thereof will be omitted.

The first conveyance screw 25 in this embodiment has the same constitution as in Embodiment 1 except for the following point.

As shown in FIG. 8(*a*), the first conveyance screw 25 in this embodiment has a shaft diameter (d) increased from d to d1 in an immediately upstream area C of the developer discharge opening 40 with respect to the developer feeding direction. More specifically, the shaft diameter d in an area other than the areas C, D and E, a shaft diameter d2 in the discharge opening opposing area D, and a shaft diameter d3 in the discharge opening downstream area E are equal to each other, i.e., d=d2=d3=8 mm. On the other hand, the shaft diameter d1 in the discharge opening upstream area C is 14 mm. In this embodiment, the blade outer diameter B of the first conveyance screw 25 is not changed in the upstream area C, so that a cross-sectional area of the blade 51 in the upstream area C is decreased in correspondence with the increase in shaft diameter in the upstream area C. For this reason, a feeding power of the first conveyance screw 25 in the upstream area C with respect to the developer feeding direction is small, so that for the same reason as in Embodiment 1, a top surface (level) of developer in an opposing area D with respect to the developer discharge opening 40 is lowered.

The lowering in the developer top surface means that an amount of developer remaining on the blade 51 of the first conveyance screw 25 is decreased in the discharge opening opposing area D, so that it is possible to decrease an amount of developer discharged through the developer discharge opening 40 in a bump manner by rotation of the first conveyance screw 25.

Accordingly, also in this embodiment, the same action (function) as in Embodiment 1 is achieved.

In this embodiment, by decreasing the amount of developer remaining on the screw blade by similarly as in Embodiment 1 by increasing in shaft diameter without changing the outer diameter of the screw blade to decrease an effective blade cross-sectional area for feeding developer by the conveyance screw 25 in the upstream area C, the developer feeding power is lowered. For this reason, the amount of developer remaining on the blade 51 of the first conveyance screw 25 in the opposing area D with respect to the developer discharge opening 40 can be further decreased, so that it is possible to suppress the discharge of developer due to bumps of developer by the screw blade in the discharge opening opposing area D.

In this embodiment, similarly as in Embodiment 1, the feeding power of the conveyance screw 25 in the downstream area E of the developer discharge opening 40 is larger than or equal to that in the discharge opening opposing area D.

As described above, in this embodiment, as shown in FIG. 8(*a*), the shaft diameter 2 of the conveyance screw 25 in the discharge opening opposing area D is equal to the shaft diameter d3 of the conveyance screw 25 in the downstream area E of the developer discharge opening 40, i.e., d2=d3, and the (average) feeding power in the opposing area D is also equal to the (average) feeding power in the downstream area E. In other words, the screw shaft diameters in this embodiment in three areas satisfy the following relationship:

$d1$ (screw shaft diameter in upstream area $C$)$<d2$ (screw shaft diameter in opposing area $D$)$=d3$ (screw shaft diameter in downstream area $E$).

In this case, the screw shaft diameter d3 is equal to a basic screw shaft diameter d of the blade, i.e., d3=d.

The screw shaft diameter d can also be modified as shown in FIG. 8(*b*).

More specifically, as shown in FIG. 8(*b*), the screw shaft diameter d of the conveyance screw 25 is gradually decreased from a left side to a right side on the drawing, i.e., in the order of d1 in the discharge opening upstream area C, d2 in the discharge opening opposing area D, and d3 in the discharge opening downstream area E. In other words, the screw shaft diameters d1, d2 and d3 in these three areas, C, D and E, respectively, satisfy the following relationship:

$d1$ (screw shaft diameter in upstream area $C$)$>d2$ (screw shaft diameter in opposing area $D$)$>d3$ (screw shaft diameter in downstream area $E$), wherein the screw shaft diameter $d3$ is equal to the basic screw shaft diameter $d$, i.e., $d3=d$.

Embodiment 4

Figure 9:
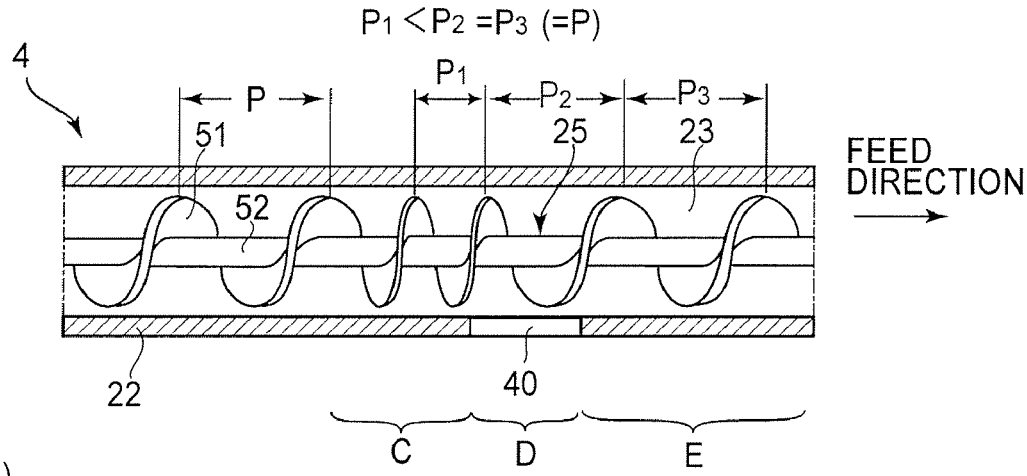
Figure 9:
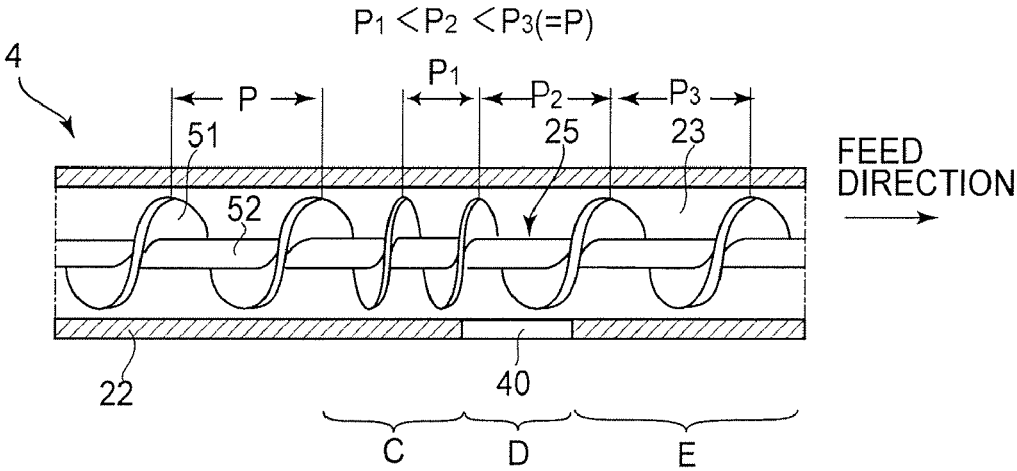

FIGS. 9(*a*) and 9(*b*) are schematic views each showing a first conveyance screw 25 in the neighborhood of a developer discharge opening 40 in a development chamber 23 of a developing apparatus 4 according to this embodiment of the present invention as viewed from above. In the following description, constituents corresponding to those in Embodiment 1 are represented by identical reference numerals or symbols and detailed explanations thereof will be omitted.

The first conveyance screw 25 in this embodiment has the same constitution as in Embodiment 1 except for the following point.

As shown in FIG. 9(*a*), the first conveyance screw 25 in this embodiment has a pitch (interval) P decreased from P to P1 in an immediately upstream area C of the developer discharge opening 40 with respect to the developer feeding direction. More specifically, the pitch P in an area other than the areas C, D and E, a pitch P2 in the discharge opening opposing area D, and a pitch P3 in the discharge opening downstream area E are 30 mm, i.e., P=P2=P3. On the other hand, the pitch P1 in the discharge opening upstream area C is 15 mm. In correspondence with the decrease in pitch of the blade 51 of the conveyance screw 25 in the upstream area C, a feeding power of the first conveyance screw 25 in the upstream area C with respect to the developer feeding direction is small, so that for the same reason as in Embodiment 1, a top surface (level) of developer in an opposing area D with respect to the developer discharge opening 40 is lowered.

The lowering in the developer top surface means that an amount of developer remaining on the blade 51 of the first conveyance screw 25 is decreased in the discharge opening opposing area D, so that it is possible to decrease an amount of developer discharged through the developer discharge opening 40 in a bump manner by rotation of the first conveyance screw 25.

Accordingly, also in this embodiment, the same action (function) as in Embodiment 1 is achieved.

In this embodiment, similarly as in Embodiment 1, the feeding power of the conveyance screw 25 in the downstream area E of the developer discharge opening 40 is larger than or equal to that in the discharge opening opposing area D.

As described above, in this embodiment, as shown in FIG. 9(*a*), the pitch P2 of the blade 51 in the discharge opening opposing area D is equal to the pitch P3 of the blade 51 in the downstream area E of the developer discharge opening 40, i.e., P2=P3, and the (average) feeding power in the opposing area D is also equal to the (average) feeding power in the downstream area E. In other words, the blade pitches P1, P2 and P3 in this embodiment in three areas satisfy the following relationship:

$P1$ (blade pitch in upstream area $C$)<$P2$ (blade pitch in opposing area $D$)=$P3$ (blade pitch in downstream area $E$).

In this case, the blade pitch P3 is equal to a basic blade pitch P of the blade, i.e., P3=P.

The blade pitch P can also be modified as shown in FIG. 9(*b*).

More specifically, as shown in FIG. 9(*b*), the blade pitch P of the blade 51 is gradually increased from a left side to a right side on the drawing, i.e., in the order of P1 in the discharge opening upstream area C, P2 in the discharge opening opposing area D, and P3 in the discharge opening downstream area E. In other words, the blade pitches P1, P2 and P3 in these three areas, C, D and E, respectively, satisfy the following relationship:

$P1$ (blade pitch in upstream area $C$)<$P2$ (blade pitch in opposing area $D$)<$P3$ (blade pitch in downstream area $E$), wherein the blade pitch $P3$ is equal to the basic blade pitch $P$, i.e., $P3=P$.

Embodiment 5

Figure 10:
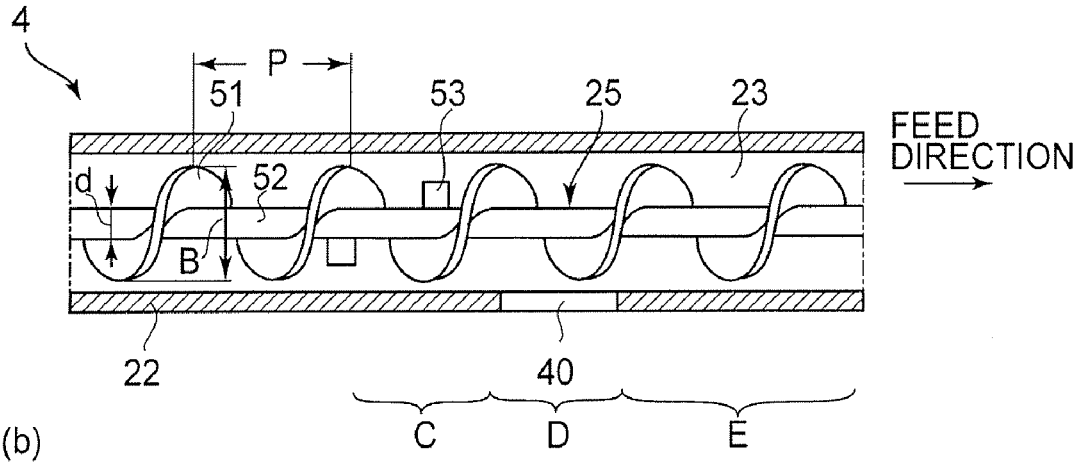
Figure 10:
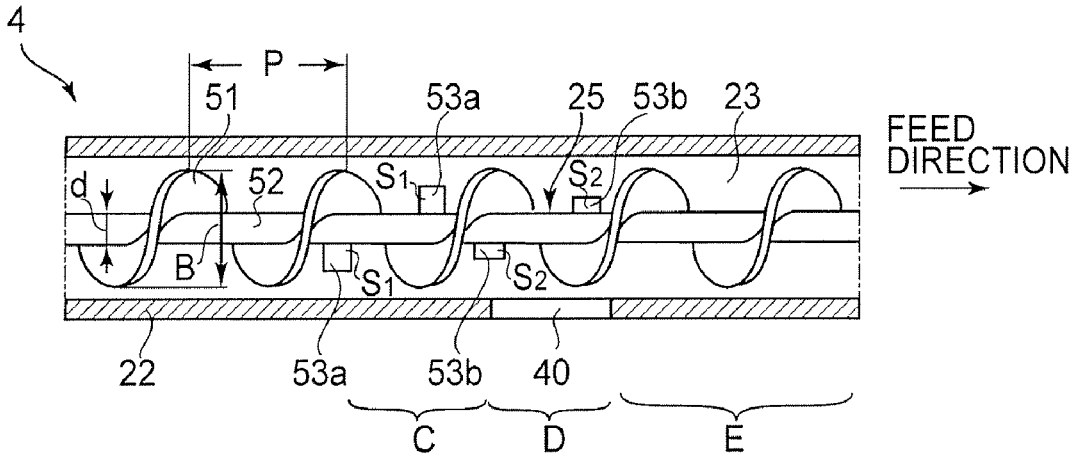

FIGS. 10(*a*) and 10(*b*) are schematic views each showing a first conveyance screw 25 in the neighborhood of a developer discharge opening 40 in a development chamber 23 of a developing apparatus 4 according to this embodiment of the present invention as viewed from above. In the following description, constituents corresponding to those in Embodiment 1 are represented by identical reference numerals or symbols and detailed explanations thereof will be omitted.

The first conveyance screw 25 in this embodiment has the same constitution as in Embodiment 1 except for the following point.

As shown in FIG. 10(*a*), the first conveyance screw 25 in this embodiment has a rib 53 disposed between adjacent blade portions 51 in an immediately upstream area C of the developer discharge opening 40 with respect to the developer feeding direction. When the rib 53 is disposed between the adjacent blade portions 51, the developer remaining between the blade portions 51 is disturbed by the rib 53. For this reason, a feeding power of the first conveyance screw 25 in the upstream area C with respect to the developer feeding direction is small, so that for the same reason as in Embodiment 1, a top surface (level) of developer in an opposing area D with respect to the developer discharge opening 40 is lowered.

The lowering in the developer top surface means that an amount of developer remaining on the blade 51 of the first conveyance screw 25 is decreased in the discharge opening opposing area D, so that it is possible to decrease an amount of developer discharged through the developer discharge opening 40 in a bump manner by rotation of the first conveyance screw 25.

Accordingly, also in this embodiment, the same action (function) as in Embodiment 1 is achieved.

In this embodiment, similarly as in Embodiment 1, the feeding power of the conveyance screw 25 in the downstream area E of the developer discharge opening 40 is larger than or equal to that in the discharge opening opposing area D.

As described above, in this embodiment, as shown in FIG. 10(*a*), the rib 53 is not provided between adjacent blade portions 51 both in the discharge opening opposing area D and the downstream area E of the developer discharge opening 40, so that the (average) feeding power in the opposing area D is also equal to the (average) feeding power in the downstream area E.

The rib 53 can also be provided as shown in FIG. 10(*b*).

More specifically, as shown in FIG. 10(*b*), in each of the discharge opening upstream area C and the discharge opening opposing area D, two ribs 53*a* and 53*a* (or 53*b* and 53*b*) are provided between adjacent blade portions 51. In this case, a stirring area S1 of the rib 53*a* provided in the discharge opening upstream area C may be larger than a stirring area S2 of the rib 53*b* provided in the discharge opening opposing area D.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 092580/2006 filed Mar. 29, 2006, which is hereby incorporated by reference.

What is claimed is:

1. A developing apparatus comprising:

a developer container that contains a developer including a toner and a carrier;

a supply device that supplies a supply developer to said developer container;

a discharge opening, provided in said developer container, that permits discharge of the developer contained in said developer container; and a feeding member, disposed close to said discharge opening in said developer container, that feeds the developer, wherein said feeding member has an average developer feeding power in an opposing area, in which said feeding member is opposed to said discharge opening, larger than an average developer feeding power in an upstream-side area which is an area directly upstream from said discharge opening with respect to a developer feeding direction, and wherein said feeding member has an average developer feeding power in a downstream-side area equal to or larger than the average developer feeding power in the opposing area, in which the downstream-side area is an area directly downstream from said discharge opening with respect to the developer feeding direction.

2. An apparatus according to claim 1, wherein said feeding member includes a rotation shaft and a helical blade portion provided on the rotation shaft, wherein the helical blade portion has an average developer feeding power in the opposing area larger than an average developer feeding power in the upstream-side area, and wherein the helical blade portion has an average developer feeding power in the downstream-side area equal to or larger than an average developer feeding power in the opposing area.

3. An apparatus according to claim 2, wherein the helical blade portion of said feeding member in the upstream-side area has a smaller outer diameter than that in the opposing area.

4. An apparatus according to claim 2, wherein the upstream-side area includes an area in which the helical blade portion is not provided.

5. An apparatus according to claim 2, wherein the rotation shaft of said feeding member in the upstream-side area has a larger outer diameter than that in the opposing area.

6. An apparatus according to claim 2, wherein the upstream-side area includes an area in which the helical blade portion has a smaller pitch than that of the helical blade portion in the opposing area.

7. An apparatus according to claim 1, wherein said feeding member includes a rotation shaft, and a helical blade portion and stirring rib which are provided on the rotation shaft, and wherein the stirring rib is not provided in the opposing area but provided in the upstream-side area.

8. An apparatus according to claim 1, wherein said feeding member includes a rotation shaft, and a helical blade portion and a stirring rib which are provided on the rotation shaft, and wherein the stirring rib has a stirring area, in the upstream-side area, larger than that in the opposing area.

9. A developing apparatus comprising:

a developer container that contains a developer including a toner and a carrier;

a supply device that supplies a supply developer including a fresh toner and a fresh carrier to said developer container;

a discharge opening, provided in said developer container, that permits discharge of the developer contained in said developer container; and a feeding member, disposed close to said discharge opening in said developer container, that feeds the developer, wherein said feeding member has an average developer feeding power in a downstream-side area larger than an average developer feeding power in an upstream-side area, in which the downstream-side area is an area directly downstream from said discharge opening with respect to a developer feeding direction, and in which the upstream-side area is an area directly upstream from said discharge opening with respect to the developer feeding direction.

10. An apparatus according to claim 1, wherein the upstream-side area is within two pitches of said feeding member directly upstream of said discharge opening with respect to the developer feeding direction.

11. An apparatus according to claim 1, wherein the upstream-side area is within a distance of 50 mm directly upstream of said discharge opening with respect to the developer feeding direction.

12. An apparatus according to claim 9, wherein the upstream-side area is within two pitches of said feeding member directly upstream of said discharge opening with respect to the developer feeding direction.

13. An apparatus according to claim 9, wherein the upstream-side area is within a distance of 50 mm directly upstream of said discharge opening with respect to the developer feeding direction.

* * * * *